United States Patent [19]

Shiozawa

[11] Patent Number: 4,509,737

[45] Date of Patent: Apr. 9, 1985

[54] SHEET FEEDING MEANS

[75] Inventor: Takao Shiozawa, Hachioji, Japan

[73] Assignee: Konishiroku Photo Industry Co., Ltd., Tokyo, Japan

[21] Appl. No.: 411,540

[22] Filed: Aug. 25, 1982

[30] Foreign Application Priority Data

Aug. 29, 1981 [JP] Japan ..... 56-128522[U]

[51] Int. Cl.[3] ..... B65H 3/52

[52] U.S. Cl. ..... 271/125

[58] Field of Search ..... 271/34, 35, 124, 125, 271/121

[56] References Cited

U.S. PATENT DOCUMENTS 2,343,479 3/1944 Ryan ..... 271/124
3,210,073 10/1965 Godlewski ..... 271/125
4,025,068 5/1977 Collins ..... 271/124
4,222,313 9/1980 Staufner ..... 271/124 X

OTHER PUBLICATIONS

IBM Technical Disclosure Bulletin, vol. 18, No. 4, pp. 957, 958, Sep. 1975, "Wear Compensation and Roll Gap Generator", G. L. Sokol.

*Primary Examiner*—Richard A. Schacher
*Attorney, Agent, or Firm*—Jordan B. Bierman

[57] ABSTRACT

A sheet double feeding prevention member is moveable into contact with a transporting member. A swing member is provided for supporting the double feeding prevention member. A moveable fitting positions the swing member at an operative position for adjustment relative to the transporting member.

6 Claims, 6 Drawing Figures

SHEET FEEDING MEANS

BACKGROUND OF THE INVENTION

1. Field of the Invention

The present invention relates to a sheet feeding means for a copying machine and the like, and more particularly to improvements in a sheet feeding means equipped with a transporting member such as a conveyor belt for transporting a sheet and a sheet double feeding prevention member which is to be brought into pressure contact with said transporting member.

2. Description of the Prior Art

In the latest sheet feeding means of this kind, a sheet double-feeding prevention member thereof is constituted so as to be supported by a swing member responding to a sheet feeding cassette for the purpose of ejecting a sheet caught in between the transporting member and the sheet double feeding prevention member, when said sheet feeding cassette is removed from the machine.

In the above sheet feeding means, conveyance of and peeling off a sheet by the function of the transporting member having a large friction factor and the sheet double feeding prevention member require adjusting the positioning between the two members very strictly. On the other hand, in the sheet feeding means constituted as mentioned above, a swing member comes down automatically so that the sheet double feeding prevention member is separated from the transporting member when no sheet feeding cassette is loaded in, and it is therefore very difficult to adjust the positioning of these members.

SUMMARY OF THE INVENTION

The object of the present invention proposes a sheet feeding means having a novel constitution that solves the problem for the adjustment of the conventional sheet feeding means as stated above. In accordance therewith, a sheet feeding means comprises a sheet feeding member for feeding a sheet from a sheet feeding cassette, a transporting member for transporting said sheet fed by said sheet feeding member, a sheet double feeding prevention member movable into contact with said transporting member for preventing double feeding of another sheet with said sheet, a swing member for supporting said double feeding prevention member swingable to an operative position, a movable fitting member for positioning the swing member at said operative position so that it can be adjusted relatively to said transporting member, and a locking member attached to the fitting member for locking said swing member in the operative position during an adjustment operation.

DETAILED DESCRIPTION OF THE PREFERRED EMBODIMENTS

Figure 1:
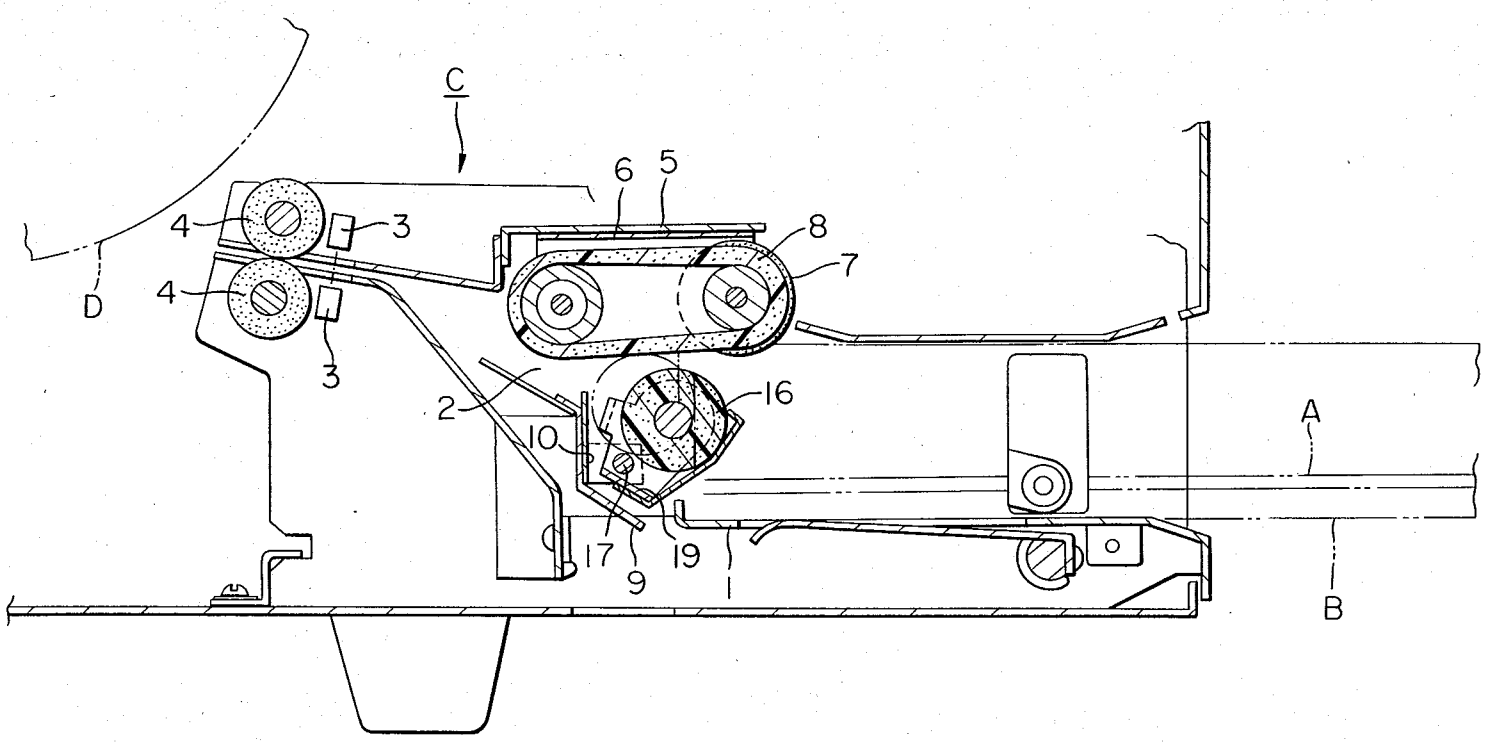
FIG. 1 shows a sectional view of a sheet feeding section of a copying machine incorporated with a sheet feeding means of the present invention.

FIG. 1 shows a sheet feeding section of a copying machine provided with the present invention, wherein, said sheet feeding section has a sheet feeding tray 1 that is capable of loading a sheet feeding cassette B in which a number of recording sheets A are stored and the recording sheets A having been put in the cassette B are fed out one after another to sheet feeding passage 2 by means of a sheet feeding means C of the present invention that is attached to the sheet feeding tray 1. In the sheet feeding passage 2, there are provided a photocoupler 3 for detecting the front edges of the recording sheet A and a sheet registration roller 4 that starts to revolve at the timing corresponding to the angle of revolution of photosensitive drum D as charge receptor.

Figure 2:
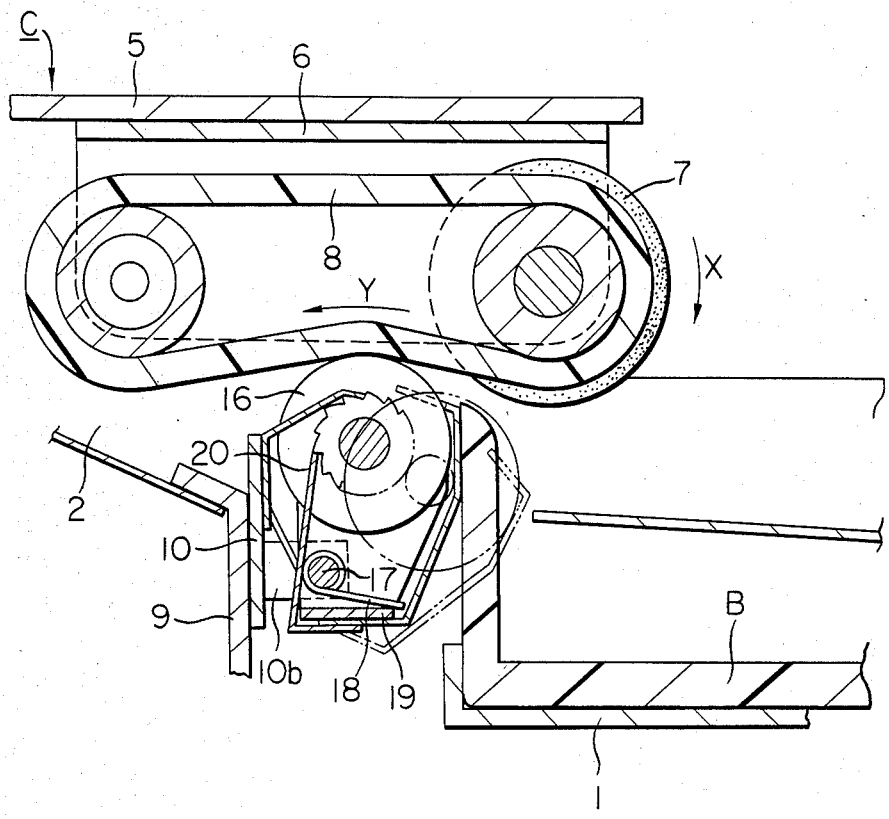
FIG. 2 shows an enlarged sectional view of the sheet feeding means showing FIG. 1.

Sheet feeding means C is provided, as enlargedly shown in FIG. 2, with a sheet feeding out roller 7 supported by a bracket 6 fixed to a primary fitting frame 5 and with a sheet feeding belt 8 wound round said sheet feeding out roller 7. Sheet feeding out roller 7 is driven to revolve in the direction of the arrow marked with X and to come into contact with the upper-most recording sheet A in the cassette B and then to draw said sheet out to the left in the drawing. Transporting belt 8 is driven by said sheet feeding out roller 7 to revolve in the direction of the arrow marked with Y, to receive the recording sheet A from the sheet feeding out roller 7 and then to transport said recording sheet A toward the sheet feeding passage 2.

Figure 5:
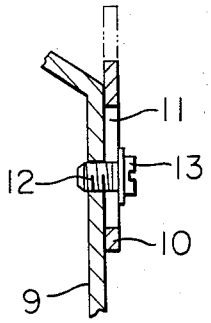
FIG. 5 shows a sectional view thereof taken on line V—V of FIG. 3.

The sheet feeding means C has a fitting plate 10 as a fitting member to be fixed to a secondary fitting frame 9 that is right underneath said transporting belt 8 so as to make the position thereof adjustable in the copying machine. The fitting plate 10 is fixed, as shown in FIGS. 3 and 5, to the secondary fitting frame 9 by a fixing screw 13 that is screwed in a tapped hole 12 of the secondary fitting frame 9 through a slit 11 of the fitting plate 10.

Figure 3:
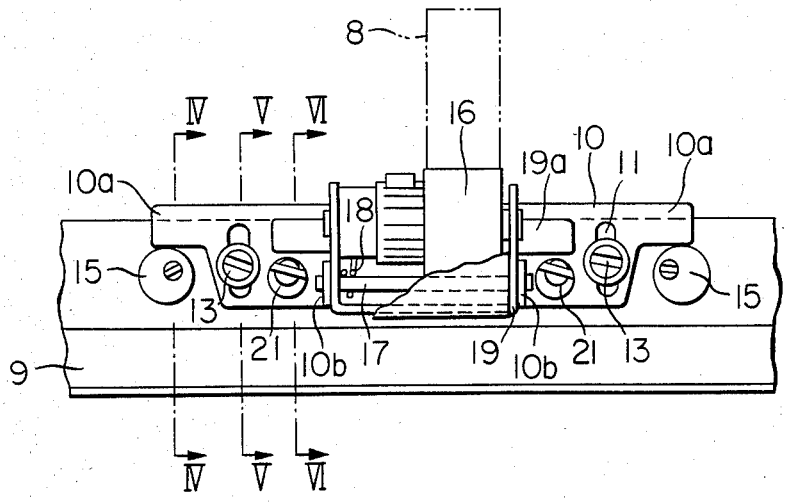
FIG. 3 shows a vertical view of the essential portion of the sheet feeding means showing FIG. 1.
Figure 4:
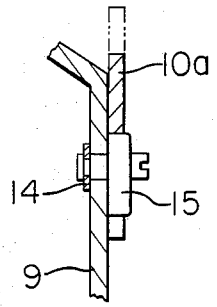
FIG. 4 shows a sectional view taken on line IV—IV of FIG. 3.

Said fitting plate 10 has wing-sections 10*a*, 10*a* with the right and left protrusions as shown in FIG. 3, and to each of the under surfaces of said wing sections there is provided eccentric cam 15, 15 respectively to secondary fitting frame 9 so as to be rotatably supported by axis 14, 14. In adjusting a sheet double feeding prevention roller 16 that will be described hereinafter, it is therefore possible to adjust the relative positioning required for a conveyor belt 8 and a sheet double feeding prevention roller 16 simply by loosening the fixing screw 13 and then by turning said eccentric cam 15 with a screw-driver or the like.

Under the fitting plate 10, there are provided a pair of bent pieces 10*b* facing opposedly to each other, and about a fulcrum axis 17 suspended between said bent pieces 10*b*, a swing member 19 is swingably supported to be energized clockwise by a spring 18 as is shown in FIG. 2. A sheet double feeding prevention roller 16 is supported so that one-way rotation thereof is hindered but the other way rotation is allowed by a rotation prevention ratchet 20 on the upper side of the swing member 19. In this connection, when a cassette B is loaded on a sheet feeding tray 1, the swing member 19 is swung by the front wall of the cassette B from the position of an imaginary line to the position of a full line, so that the circumferential surface of the sheet double feeding prevention roller 16 can be brought into pressure contact with the surface of the transporting belt 8.

Figure 6:
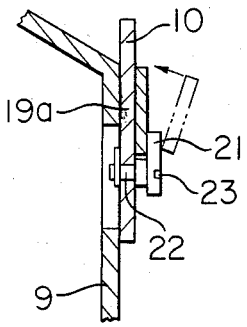
FIG. 6 shows a sectional view thereof taken on line VI—VI of FIG. 3.

On the other hand, there are locking pieces 19*a*, 19*a* respectively on each of the right and left sides of said swing member 19 as are seen in FIG. 3, and said locking pieces 19*a*, 19*a* can come into contact with the surface of the fitting plate 10 when swing member 19 is at the operation position indicated by a full line in FIG. 2. On the surface of the fitting plate 10 facing to said locking pieces 19*a*, 19*a*, there are provided locking members embodied to serve as eccentric discs 21. More concretely as shown in FIG. 6, these eccentric discs 21 are fixed respectively to the ends of axes supported rotatably by the fitting plate 10 and can be intervened in the loci of the motions of locking pieces 19*a* by being rotated by means of a tool such as screw-driver or the like that is to engage in groove 23 formed on the surface of said eccentric discs, respectively. Accordingly, locking pieces 19*a* are deterred by means of operating for eccentric discs 21 as shown in FIG. 6, and thereby the swing member 19 is locked at the operational position indicated in FIG. 2.

Next, adjusting the sheet feeding means C will be described hereunder. First, a swing member 19 is positioned for operation as shown in FIG. 2 and locking pieces 19*a* are deterred by means of operating for rotating eccentric discs 21, and thus the swing member 19 and a sheet double feeding prevention roller 16 is locked up at said position for operation. Accordingly, it is possible to attain the necessary correlation between the sheet double feeding prevention roller 16 and the transporting belt 8 by adjusting the positional relation between the fitting plate 10 and the transporting belt 8 by means of eccentric cams 15, 15 with loosening fixing screws 13, 13 and also with measuring the pressure between said sheet double feeding prevention roller 16 and said transporting belt 8, therefore, all the adjustments can be completed by simply fastening fixing screws 13, 13 with keeping said relation.

As is obvious from the above description, according to the present invention, it is possible to fix a sheet double feeding prevention roller, i.e., a sheet double feeding prevention member at the position for operation by means of eccentric discs, i.e., locking members, so that the fine adjustment of the positional relation between the sheet double feeding prevention member and the transporting member can be attained by adjusting the position of the fitting plate without feeding a plurality of sheets of paper erroneously at the same time.

Also, in the invention, the functions of the sheet double feeding prevention member can be restored by only operating the locking members, therefore, it has the effects of very easy and simple handling, etc.

What is claimed is:

1. A sheet feeding means comprising a sheet feeding member for feeding a sheet from a sheet feeding cassette, a transporting member for transporting said sheet fed by said sheet feeding member, a sheet double feeding prevention member movable into contact with said transporting member for preventing double feeding of another sheet with said sheet, a swing member for supporting said sheet double feeding prevention member swingable to an operative position, a movable fitting member for positioning the swing member at said operative position so that it can be adjusted relatively to said transporting member, and a locking member attached to the fitting member for locking said swing member in the operative position during an adjustment operation.

2. A sheet feeding means according to claim 1, wherein said transporting member is an endless belt wound around at least two rollers.

3. A sheet feeding means according to claim 2, wherein one of said rollers is the sheet feeding member.

4. A sheet feeding means according to claim 1, wherein said locking member is an eccentric disc.

5. A sheet feeding means according to claim 4, wherein said eccentric disc is rotatable about an axis and is fixed to a frame supporting the fitting member with the locking member and the swing member.

6. A sheet feeding apparatus comprising a tray upon which a cassette carrying a plurality of sheets can be installed by a forward movement and from which the cassette can be removed by a rearward movement, a feeding member mounted above a front portion of said tray for engaging the sheets in said installed cassette to feed them forwardly, a sheet double feeding prevention member beneath said feeding member and movable into contact therewith to prevent double sheet feeding, wherein said sheet double feeding prevention member is arranged swingably so as to come into pressure contact in an operative position with said feeding member when said cassette is in its installed position and so as to be separated from said feeding member when said cassette is removed from said installed position, said sheet double feeding prevention member having a roller which is movable in a one-way rotation to provide friction with said feeding member, and adjusting means for adjusting the position of said sheet double feeding prevention member in the operative position relative to said feeding member during an adjusting operation.

* * * * *